US011480193B2

(12) United States Patent
Whitmire et al.

(10) Patent No.: US 11,480,193 B2
(45) Date of Patent: Oct. 25, 2022

(54) FAN

(71) Applicant: TTI (MACAO COMMERCIAL OFFSHORE) LIMITED, Macau (MO)

(72) Inventors: J. Porter Whitmire, Greenville, SC (US); Michael J. Caso, III, Anderson, SC (US); Miles Moody, Simpsonville, SC (US); Mark Huggins, Anderson, SC (US); J. Luke Jenkins, Anderson, SC (US)

(73) Assignee: Techtronic Power Tools Technology Limited, Tortola (VG)

( * ) Notice: Subject to any disclaimer, the term of this patent is extended or adjusted under 35 U.S.C. 154(b) by 1011 days.

(21) Appl. No.: 16/166,273

(22) Filed: Oct. 22, 2018

(65) Prior Publication Data

US 2019/0120248 A1 Apr. 25, 2019

Related U.S. Application Data

(60) Provisional application No. 62/575,125, filed on Oct. 20, 2017.

(51) Int. Cl.
*F04D 29/42* (2006.01)
*F04D 25/08* (2006.01)
(Continued)

(52) U.S. Cl.
CPC ..... *F04D 29/4226* (2013.01); *F04D 17/16* (2013.01); *F04D 25/08* (2013.01);
(Continued)

(58) Field of Classification Search
CPC ..... F04D 17/16; F04D 25/08; F04D 25/088; F04D 29/281; F04D 29/4213; F04D 29/703; F04D 29/4226; F04F 5/16
See application file for complete search history.

(56) References Cited

U.S. PATENT DOCUMENTS 2,108,652 A 2/1938 Coanda
3,747,726 A * 7/1973 Walter ..... B60V 1/02 180/129

(Continued)

FOREIGN PATENT DOCUMENTS

CA 2928486 A1 3/2009
CA 2756861 A1 10/2010

(Continued)

*Primary Examiner* — Topaz L. Elliott
*Assistant Examiner* — Aye S Htay
(74) *Attorney, Agent, or Firm* — Michael Best & Friedrich LLP

(57) ABSTRACT

A fan includes a central hub defining an inlet, a motor positioned within the central hub, and an impeller positioned within the central hub. The impeller is operable to be rotated by the motor to generate air movement. The fan also includes a nozzle defining a channel that receives the airflow from the central hub. The nozzle also defines an outlet in communication with the channel to direct air out of the nozzle. The fan further includes a plurality of conduits connecting the nozzle to the central hub to direct air from the central hub to the channel and through the outlet of the nozzle. The nozzle defines a projection aligned with each conduit to divide air movement through the nozzle.

20 Claims, 17 Drawing Sheets

(51) Int. Cl.

| | |
|---|---|
| ***F04F 5/16*** | (2006.01) |
| ***F04D 29/28*** | (2006.01) |
| ***F04D 29/70*** | (2006.01) |
| ***F04D 17/16*** | (2006.01) |
| ***F04F 5/46*** | (2006.01) |

(52) U.S. Cl.
CPC ..... *F04D 25/088* (2013.01); *F04D 29/281* (2013.01); *F04D 29/4213* (2013.01); *F04D 29/703* (2013.01); *F04F 5/16* (2013.01); *F04F 5/46* (2013.01)

(56) References Cited

U.S. PATENT DOCUMENTS

| | | | | |
|---|---|---|---|---|
| 4,452,566 | A * | 6/1984 | Kardas | F04D 25/045 415/80 |
| 5,462,407 | A * | 10/1995 | Calvo | F04D 25/088 D23/413 |
| 5,607,289 | A * | 3/1997 | Sills | E02F 5/003 415/80 |
| 7,381,129 | B2 | 6/2008 | Wedon | |
| 7,931,449 | B2 | 4/2011 | Fitton et al. | |
| 7,972,111 | B2 | 7/2011 | Crawford et al. | |
| 8,092,166 | B2 | 1/2012 | Nicolas et al. | |
| 8,308,445 | B2 | 11/2012 | Gammack et al. | |
| 8,403,650 | B2 | 3/2013 | Gammack et al. | |
| 8,430,624 | B2 | 4/2013 | Cookson et al. | |
| 8,613,601 | B2 | 12/2013 | Helps | |
| 8,764,412 | B2 | 7/2014 | Gammack et al. | |
| 9,004,858 | B2 | 4/2015 | Nicolas et al. | |
| 9,022,731 | B2 | 5/2015 | Seccareccia | |
| 9,062,685 | B2 | 6/2015 | Stewart et al. | |
| 9,194,596 | B2 | 11/2015 | Dyson et al. | |
| 9,249,810 | B2 | 2/2016 | Gammack et al. | |
| 9,360,020 | B2 * | 6/2016 | Janecek | F04D 25/088 |
| 2004/0091350 | A1 | 5/2004 | Graziosi et al. | |
| 2006/0128299 | A1 | 6/2006 | Wu | |
| 2007/0155304 | A1 * | 7/2007 | Hyun | F04D 29/36 62/426 |
| 2013/0017106 | A1 | 1/2013 | Stewart et al. | |
| 2013/0129590 | A1 | 5/2013 | Dos Reis et al. | |
| 2013/0302146 | A1 | 11/2013 | Dyson et al. | |
| 2013/0309080 | A1 | 11/2013 | Johnson et al. | |
| 2014/0199185 | A1 | 7/2014 | Nicolas et al. | |
| 2014/0199186 | A1 | 7/2014 | Nicolas et al. | |
| 2015/0086360 | A1 | 3/2015 | Stewart et al. | |
| 2015/0086390 | A1 | 3/2015 | Andrew et al. | |
| 2016/0138404 | A1 | 5/2016 | Chen | |
| 2016/0186765 | A1 | 6/2016 | Wedon | |

FOREIGN PATENT DOCUMENTS

| | | | |
|---|---|---|---|
| CA | 2746499 | C | 3/2012 |
| CA | 2824649 | A1 | 6/2012 |
| CA | 2746496 | C | 12/2012 |
| CA | 2838941 | A1 | 12/2012 |
| CA | 2841942 | A1 | 1/2013 |
| CA | 2698489 | C | 2/2013 |
| CA | 2559610 | C | 4/2013 |
| CA | 2873301 | A1 | 11/2013 |
| CA | 2873302 | A1 | 11/2013 |
| CA | 2776814 | C | 4/2015 |
| CA | 2746540 | C | 3/2016 |
| CA | 2698490 | C | 7/2016 |
| CA | 2838934 | C | 8/2016 |
| GB | 1009170 | A | 11/1965 |
| GB | 2081872 | A | 2/1982 |
| GB | 2452593 | A | 3/2009 |
| GB | 2484276 | A | 4/2012 |
| GB | 2468314 | B | 12/2012 |
| GB | 2502105 | B | 1/2016 |
| MX | 2010002496 | A | 6/2010 |
| MX | 2012004972 | A | 7/2012 |
| WO | 2011129073 | A1 | 10/2011 |
| WO | 2012045255 | A1 | 4/2012 |
| WO | 2016086497 | A1 | 6/2016 |

* cited by examiner

FAN

CROSS REFERENCE TO RELATED APPLICATIONS

This application claims priority to U.S. Provisional Patent Application No. 62/575,125, filed Oct. 20, 2017, the entire contents of which are incorporated herein by reference.

BACKGROUND

The present invention relates to fans and, more particularly, to ceiling fans.

Ceiling fans are typically mounted to ceilings to circulate air within rooms. Some fans include blades or impellers positioned within a housing such that the blades or impellers are not visible to a user. These fans are commonly referred to as bladeless fans. A bladeless fan typically draws air through an opening in the housing and guides the air through inner pathways until the air is pushed out of airways in the desired direction. Taking advantage of the Bernoulli principle and Coanda effect, the geometry uses high velocity air expelled from the nozzle to draw additional surrounding air into the air movement zone; increasing total air movement.

SUMMARY

In one embodiment, the invention provides a fan including a central hub defining an inlet, a motor positioned within the central hub, and an impeller positioned within the central hub. The impeller is operable to be rotated by the motor to generate air movement. The fan also includes a nozzle that defines a channel that receives air from the central hub. The nozzle also defines an outlet in communication with the channel to direct air out of the nozzle. The fan further includes a plurality of conduits connecting the nozzle to the central hub to direct air from the central hub to the channel and through the outlet of the nozzle. The nozzle defines a projection aligned with each conduit to divide air movement through the nozzle.

In another embodiment, the invention provides a fan including a central hub defining an inlet, a motor positioned within the central hub, and an impeller positioned within the central hub. The impeller is operable to be rotated by the motor to generate air movement. The impeller includes fins. Each fin has an edge treatment of ridges and valleys formed on an outer edge of the fin. The fan also includes a nozzle that defines a channel that receives air from the central hub. The nozzle defines an outlet in communication with the channel to direct air out of the nozzle. The fan further includes a plurality of conduits connecting the nozzle to the central hub to direct air from the central hub to the channel and through the outlet of the nozzle.

In another embodiment, the invention provides a fan including a central hub defining an inlet, a motor positioned within the central hub, and an impeller positioned within the central hub. The impeller is operable to be rotated by the motor to generate air movement. The fan also includes a filter covering the inlet. The filter is divided into a plurality of pieces that are separately removable from the central hub. The fan further includes a nozzle that defines a channel that receives air from the central hub. The nozzle also defines an outlet in communication with the channel to direct air out of the nozzle. The fan further includes a plurality of conduits connecting the nozzle to the central hub to direct air from the central hub to the channel and through the outlet of the nozzle.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
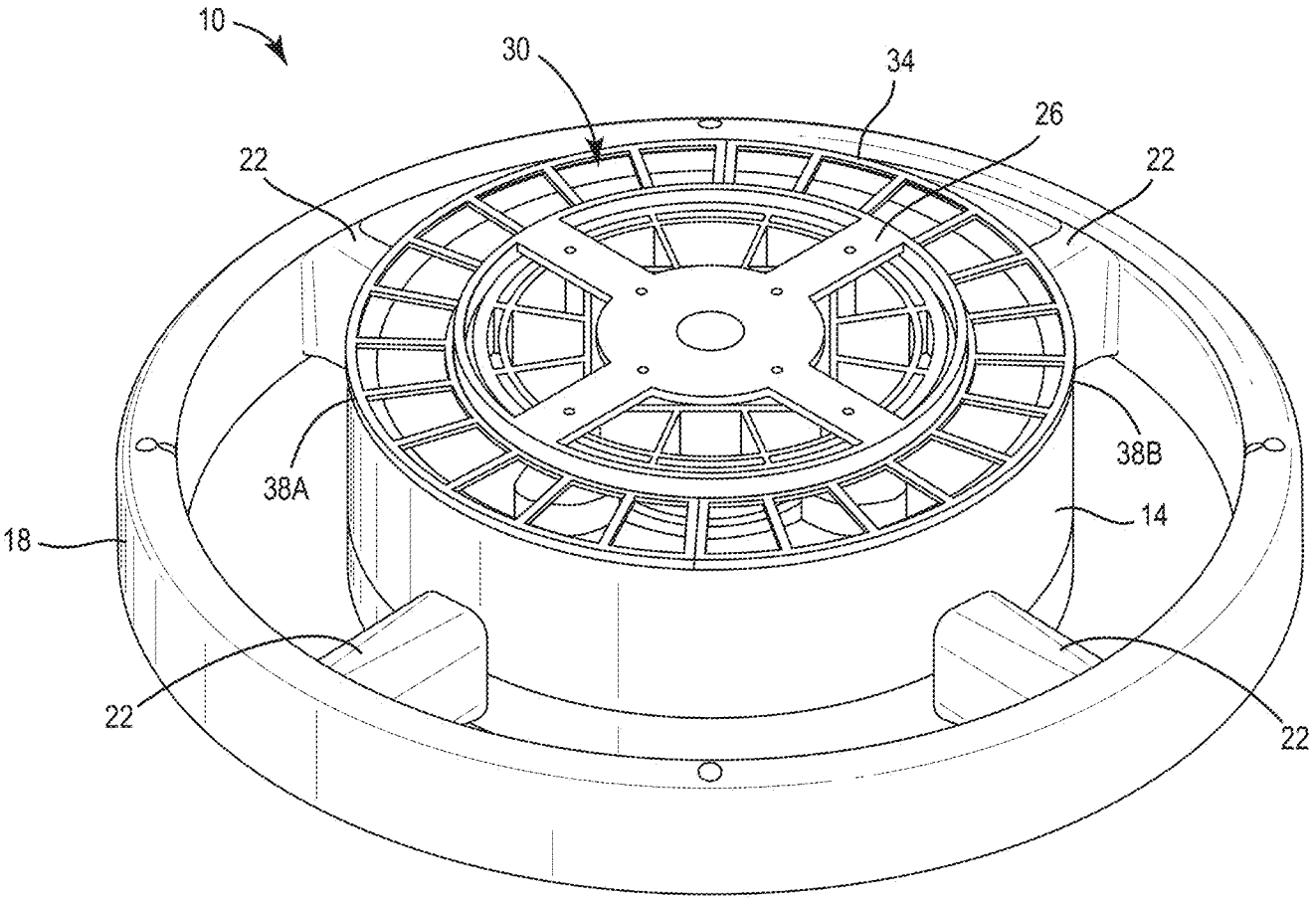
FIG. 1 is a top perspective view of a ceiling fan embodying the invention.
Figure 2:
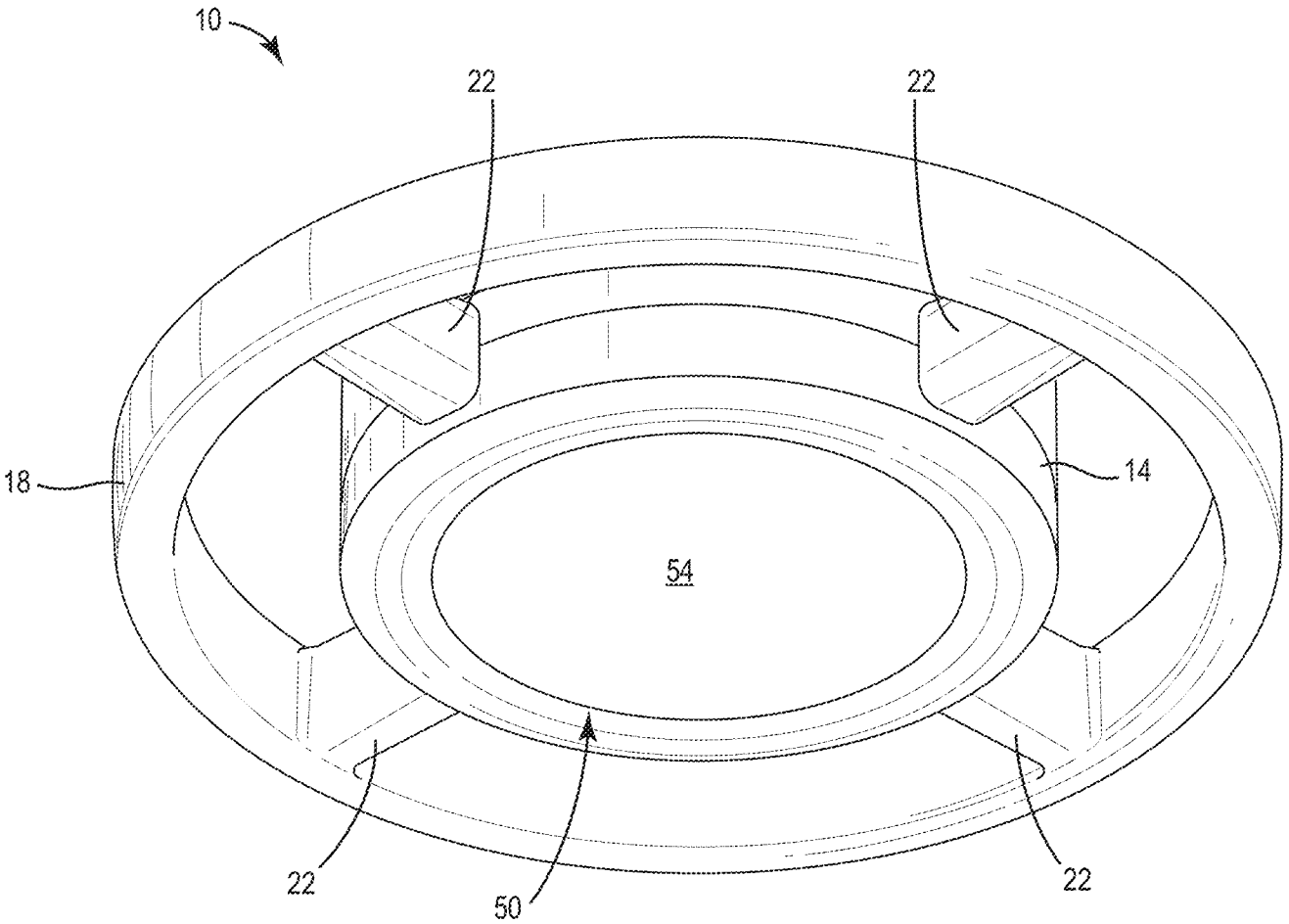
FIG. 2 is a bottom perspective view of the ceiling fan.
Figure 3:
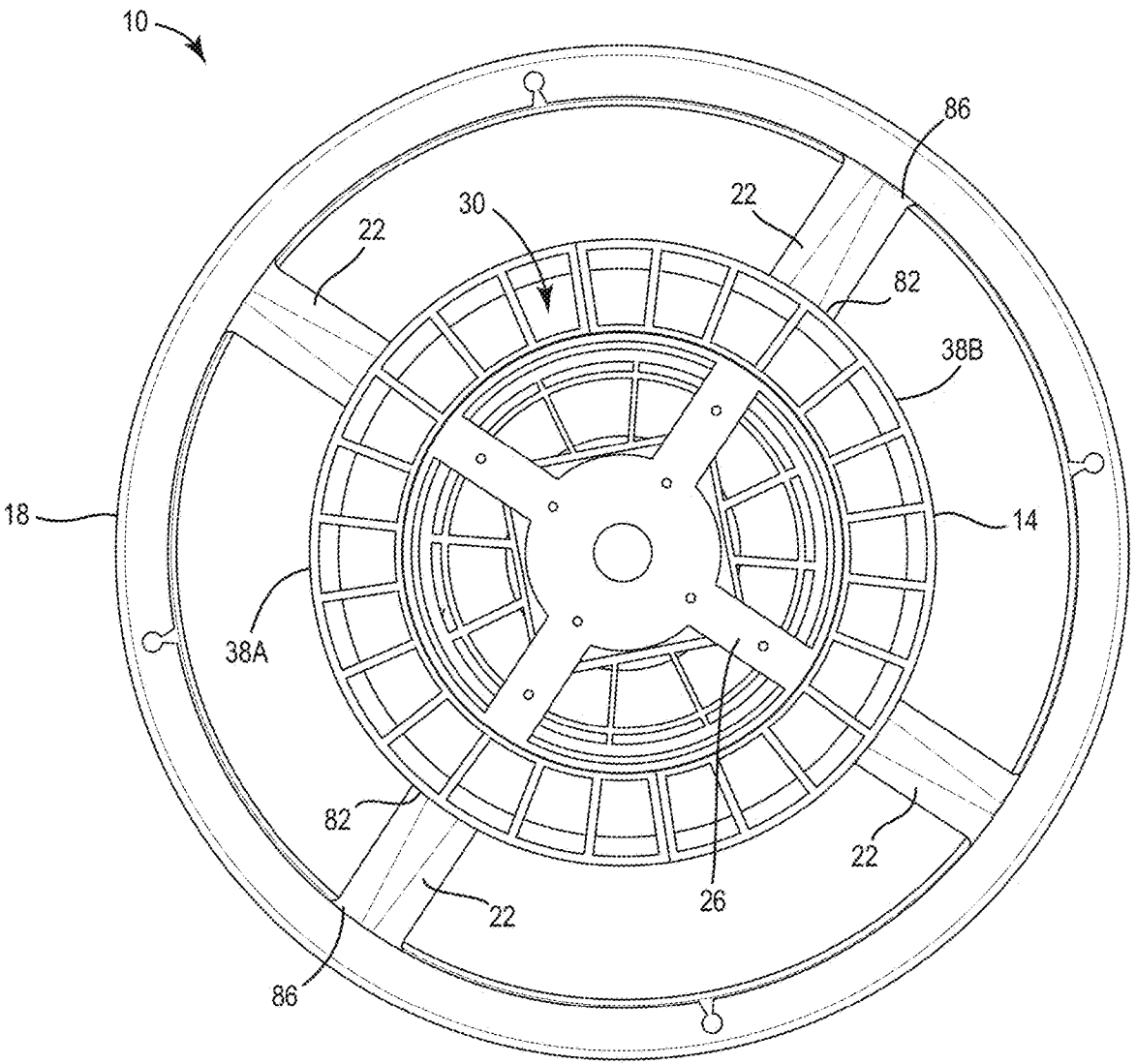
FIG. 3 is a top plan view of the ceiling fan.

FIGS. 1-3 illustrate a fan 10. In the illustrated embodiment, the fan 10 is a ceiling fan that mounts to a ceiling or other overhead structure in a room or area. Aspects of the invention, however, may also be applied to other types of fans, such as pedestal fans, tabletop fans, box fans, window fans, and the like.

The illustrated fan 10 includes a central hub 14, an annular nozzle 18, and a plurality of conduits 22 connecting the annular nozzle 18 to the central hub 14. The central hub 14 is positioned within a perimeter defined by the annular nozzle 18. For example, in the illustrated embodiment, the annular nozzle 18 surrounds the central hub 14. In other embodiments, the central hub may be positioned axially above or below the annular nozzle 18 but still within a perimeter defined by the annular nozzle. The central hub 14 is generally cylindrical and includes a mount 26 for connecting the fan 10 to a ceiling or other suitable surface. The central hub 14 also defines an inlet 30 for directing air into the fan 10. The inlet 30 is covered by a filter 34, which filters the air as the air enters the fan 10. In the illustrated embodiment, the filter 34 is a ring-shaped member that is divided into first and second pieces 38A, 38B. More particularly, the first and second pieces 38A, 38B are identical or are mirror symmetric so that they are the same shape. In other embodiments, the filter 34 may be divided into a plurality of pieces. This arrangement allows the filter 34 to be removed and replaced without having to disconnect the fan 10 from the ceiling.

Figure 4:
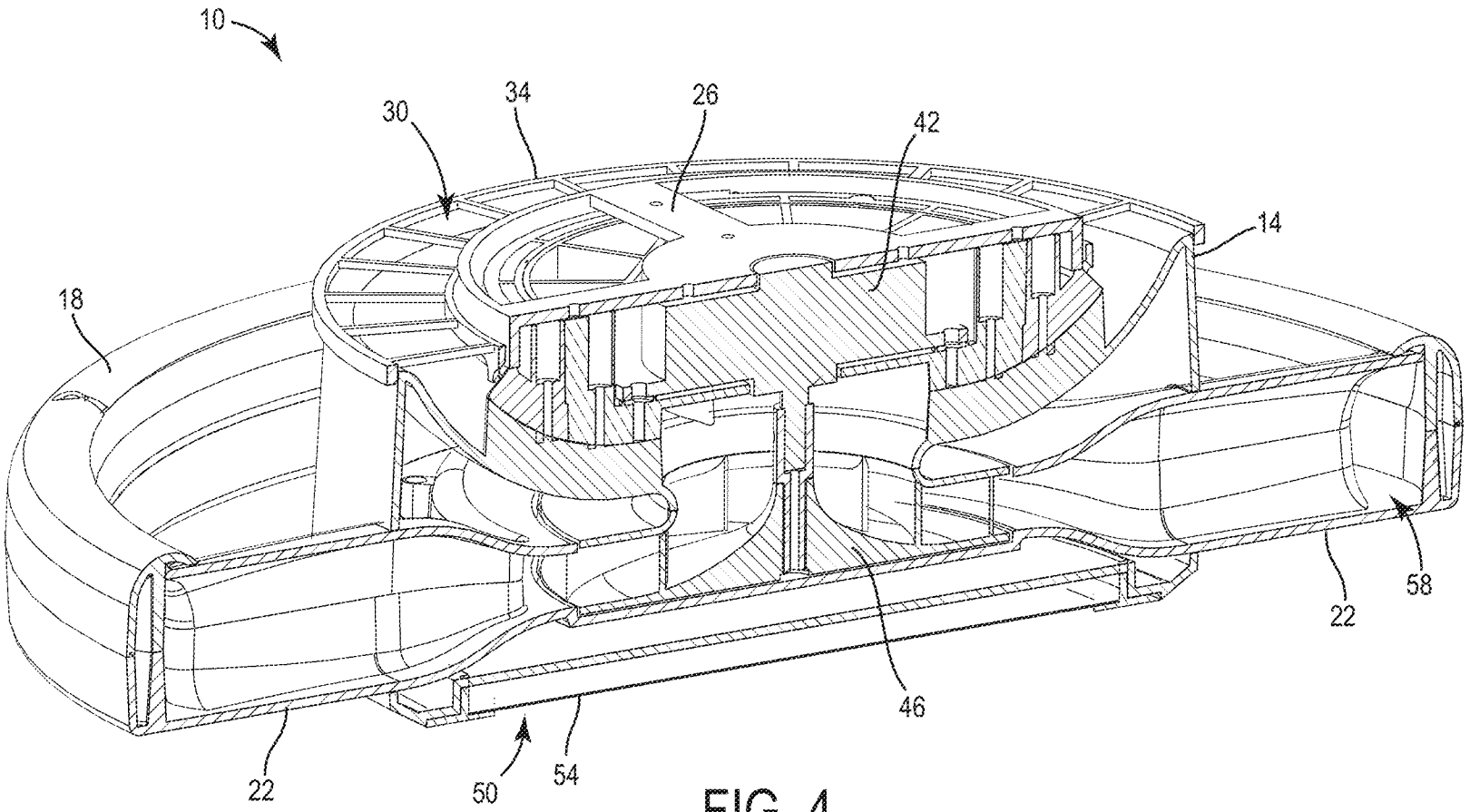
FIG. 4 is a cross-sectional view of the ceiling fan.

As shown in FIG. 4, the fan 10 includes a motor 42 and an impeller 46 positioned within the central hub 14. In the illustrated embodiment, the motor 42 is positioned beneath and axially aligned with the mount 26, and the impeller 46 is positioned beneath and axially aligned with the motor 42. In some embodiments, the impeller 46 may be positioned above the motor 42. In some embodiments, the motor 42 may be powered by an AC power line in, for example, a wall or ceiling of a building. In other embodiments, the motor 42 may be powered by a battery pack, such as a rechargeable power tool battery pack. When the motor 42 is energized, the motor 42 rotates the impeller 46. As the impeller 46 rotates, the impeller 46 draws air into the fan 10 through the inlet (FIG. 1). In some embodiments, the fan 10 may include angled blades positioned upstream of the impeller 46 that help orient the air movement in the direction opposite to the rotation of the impeller 46, thereby increasing the efficiency of the impeller 46. The impeller 46 propels and directs the air through the conduits 22 to the annular nozzle 18. In some embodiments, the motor 42 may rotate at a speed between 1500 rpms and 3500 rpms. Additionally, the impeller 46 may rotate at a tip speed between about 13 m/s and about 32 m/s. In some embodiments, the rotational speeds of the motor 42 and the impeller 46 may be variable by a user (e.g., between low, medium, and high speeds), depending on the amount of air movement desired.

Referring back to FIG. 2, the illustrated central hub 14 also supports a light module 50. The light module 50 includes a light source and a lens 54 covering the light source. In some embodiments, the light source may include, for example, one or more light emitting diodes (LEDs). In other embodiments, other suitable light sources may be used. In the illustrated embodiment, the light source is positioned beneath and axially aligned with the impeller 46 to direct light generally downwardly from the fan 10.

Figure 5:
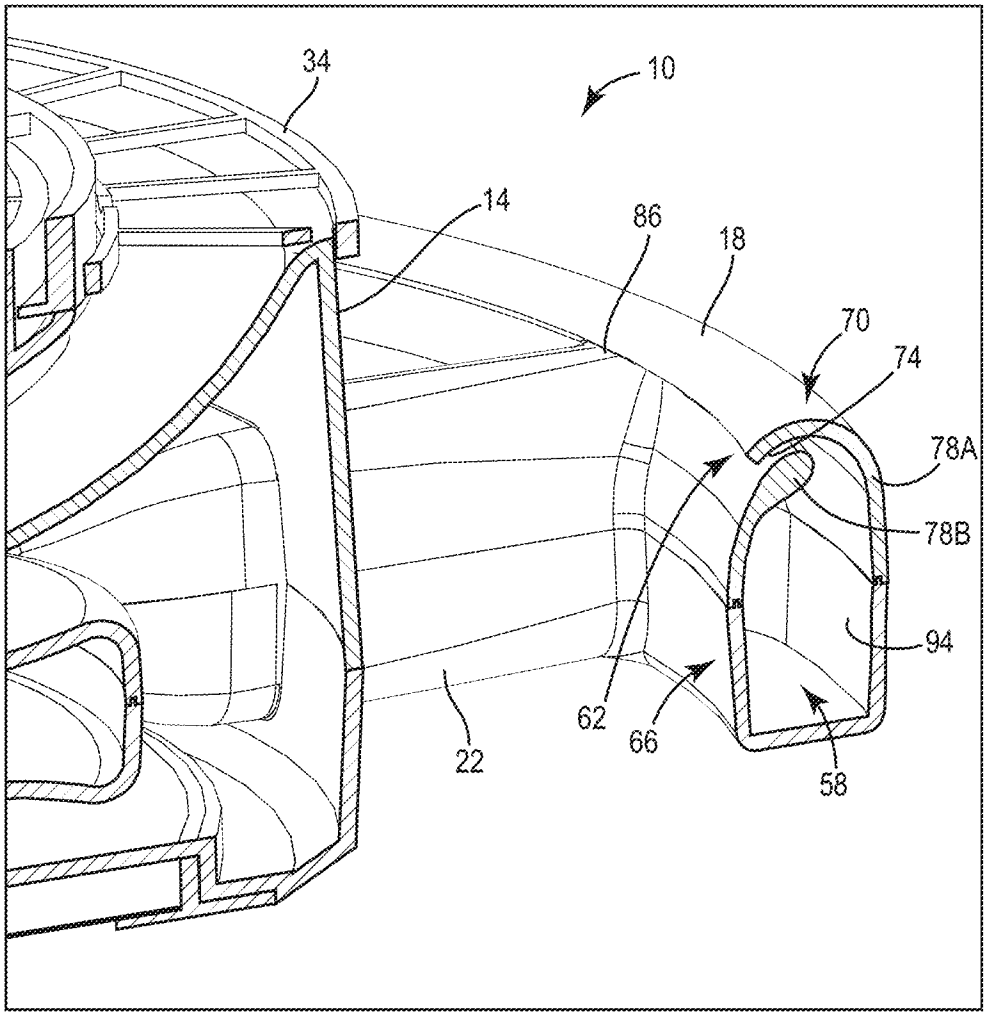
FIG. 5 is an enlarged cross-sectional view of a portion of the ceiling fan.
Figure 6:
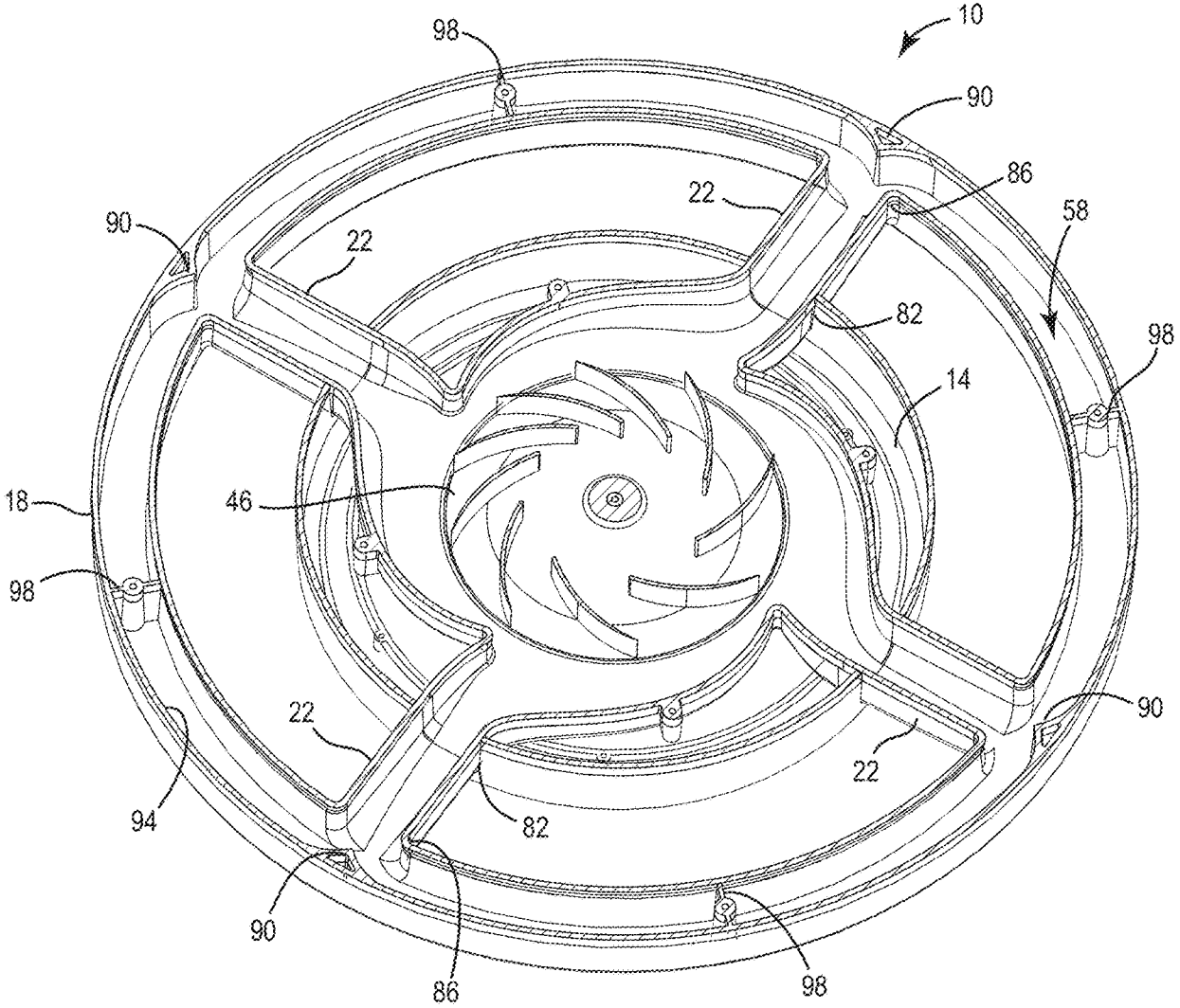
FIG. 6 is another cross-sectional view of the ceiling fan, the ceiling fan having an annular nozzle with projections to divide air movement.

The annular nozzle 18 surrounds the central hub 14 and is supported by the conduits 22. In other embodiments, the nozzle 18 does not need to be annular. For example, the nozzle 18 may be oblong, square, rectangular, hexagonal, or oval shaped. As shown in FIGS. 5 and 6, the annular nozzle 18 defines a channel 58 that receives air from the central hub 14. The annular nozzle 18 also defines an outlet 62 in communication with the channel 58 to direct the air out of the fan 10. In the illustrated embodiment, the outlet 62 is defined on an inner diameter 66 of the annular nozzle 18. In addition, the outlet 62 is defined adjacent an upper end 70 of the annular nozzle 18. The illustrated outlet 62 is defined by a gap 74 between two walls 78A, 78B of the annular nozzle 18. More particularly, one end of a first wall 78A overlaps one end of a second wall 78B to define the gap 74. In some embodiments, the gap 74 may have a width of between 1 mm and 5 mm. In other embodiments, the gap 74 may preferably have a width of about 3 mm.

As shown in FIG. 6, the conduits 22 extend radially from the central hub 14 and support the annular nozzle 18. In the illustrated embodiment, the fan 10 includes four conduits 22 that are spaced apart around the central hub 14. In other embodiments, the fan 10 may include fewer or more conduits 22. Each conduit 22 has a first end 82 coupled to the central hub 14 and a second end 86 coupled to the annular nozzle 18. The conduits 22 define flowpaths from the central hub 14 (and, more particularly, the impeller 46) to the annular nozzle 18. In operation, air is drawn into the fan 10 through the inlet 30 (FIG. 1), passes over and is propelled by the impeller 46, is directed through the conduits 22, moves into the channel 58 of the annular nozzle 18, and is directed out of the fan 10 through the outlet 62 (FIG. 5).

With continued reference to FIG. 6, the annular nozzle 18 includes a plurality of projections 90 associated with the conduits 22. In particular, one projection 90 is aligned with each conduit 22. The projections 90 are formed on an inner surface 94 of the annular nozzle 18 and extend toward the corresponding conduit 22. The projections 90 help divide the air movement exiting the conduits 22 to reduce turbulence, and thereby noise, within the annular nozzle 18.

Figure 7:
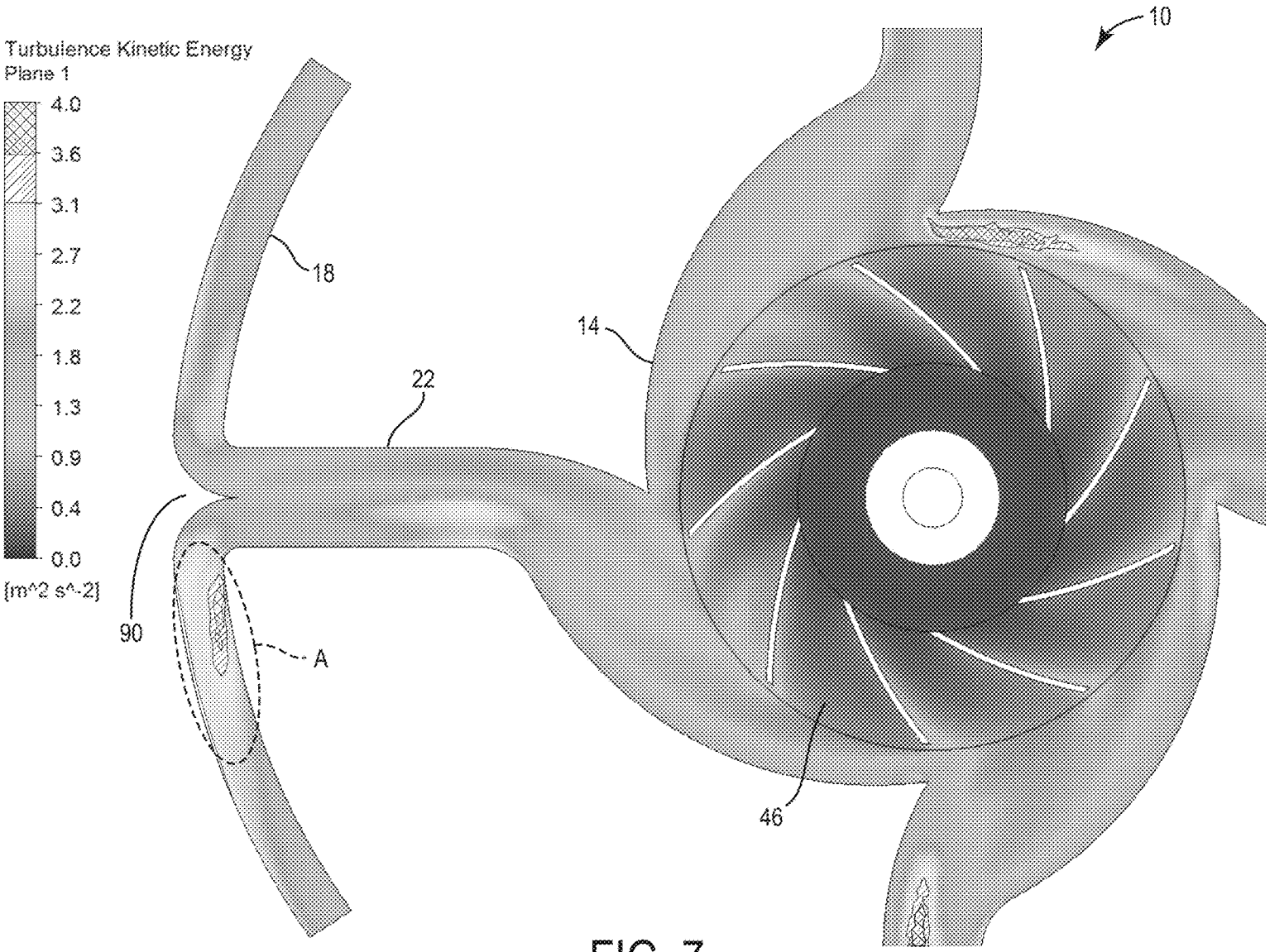
FIG. 7 is a schematic of the ceiling fan, depicting air movement turbulence through the nozzle with the projections.
Figure 8:
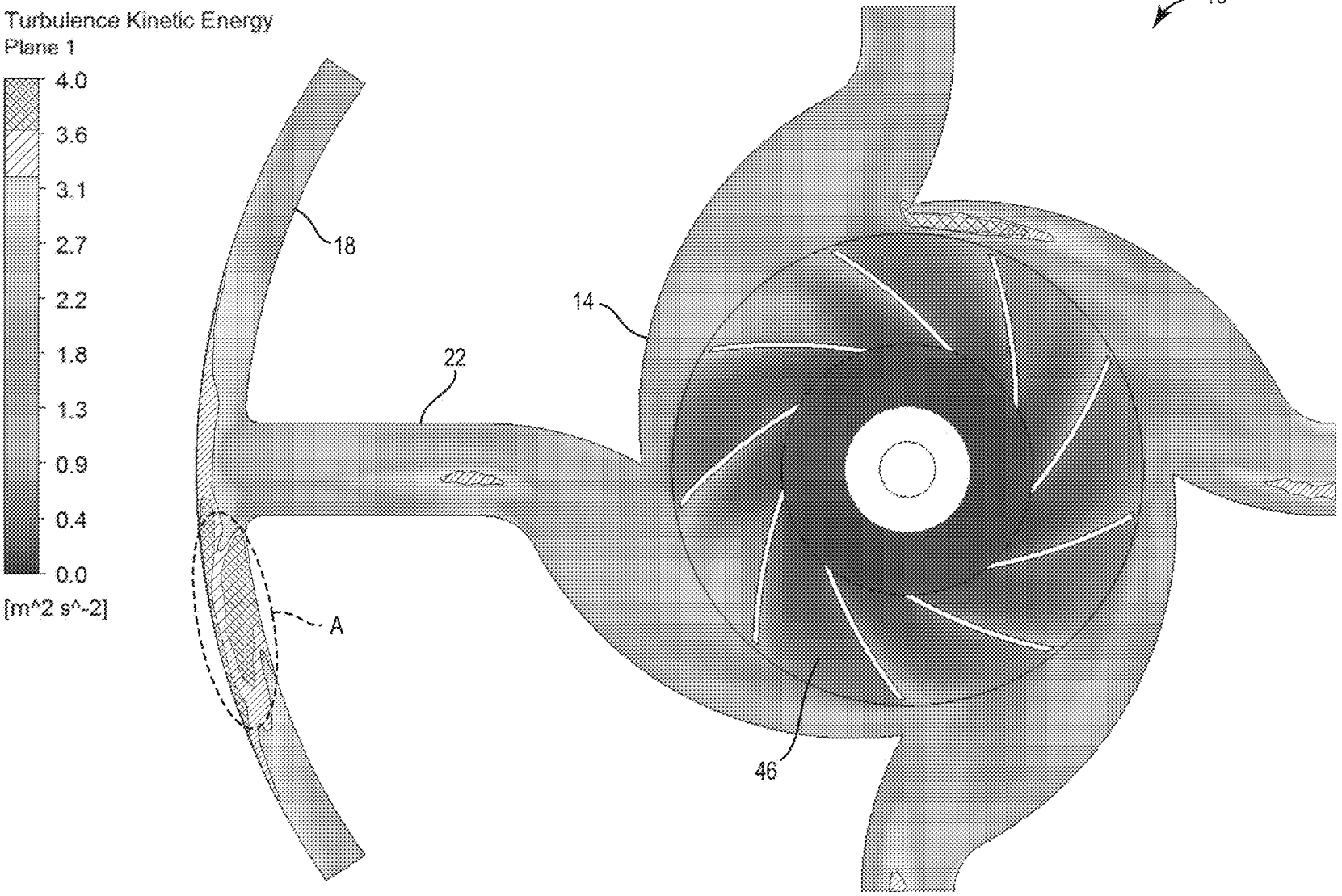
FIG. 8 is a schematic of a ceiling fan, depicting air movement turbulence through a nozzle without the projections.

FIG. 7 is a turbulent kinetic energy diagram depicting turbulence within the fan 10 with the projections 90, while FIG. 8 is a turbulent diagram depicting turbulence in a similar fan 10', but without the projections 90. As seen in FIG. 8, without the projections 90, turbulence within the annular nozzle 18 is higher (see area A) than turbulence in the same area of the fan 10 with the projections 90. The reduction in turbulence seen in FIG. 7 decrease the amount of noise generated by the fan 10 during operation.

Referring back to FIG. 6, the annular nozzle 18 also includes a plurality of baffles 98 spaced apart within the channel 58. In the illustrated embodiment, the annular nozzle 18 includes four baffles 98 separating the annular nozzle 18 into four discrete sections, each section associated with one of the conduits 22. In other embodiments, the annular nozzle 18 may include fewer or more baffles 98, depending on the number of conduits 22. The sections of the annular nozzle 18 are considered discrete in that the portion of each channel 58 within each section does not directly communicate with the portions of the channels 58 in adjacent sections. Rather, the baffles 98 isolate the portions of the channel 58 from each other. This is because, in some scenarios, the air exiting the conduits 22 and being divided by the projections 90 may be unevenly split by the projections 90 as the air moves into the channel 58. For example, 40% of the air may move in one direction out of the conduit 22, while 60% of the air movement may move in the opposite direction out of the conduit 22. The baffles 98 inhibit a "60%" air movement out of one conduit 22 from mixing with a "40%" air movement out of an adjacent conduit 22, which may otherwise create additional turbulence and noise.

Figure 9:
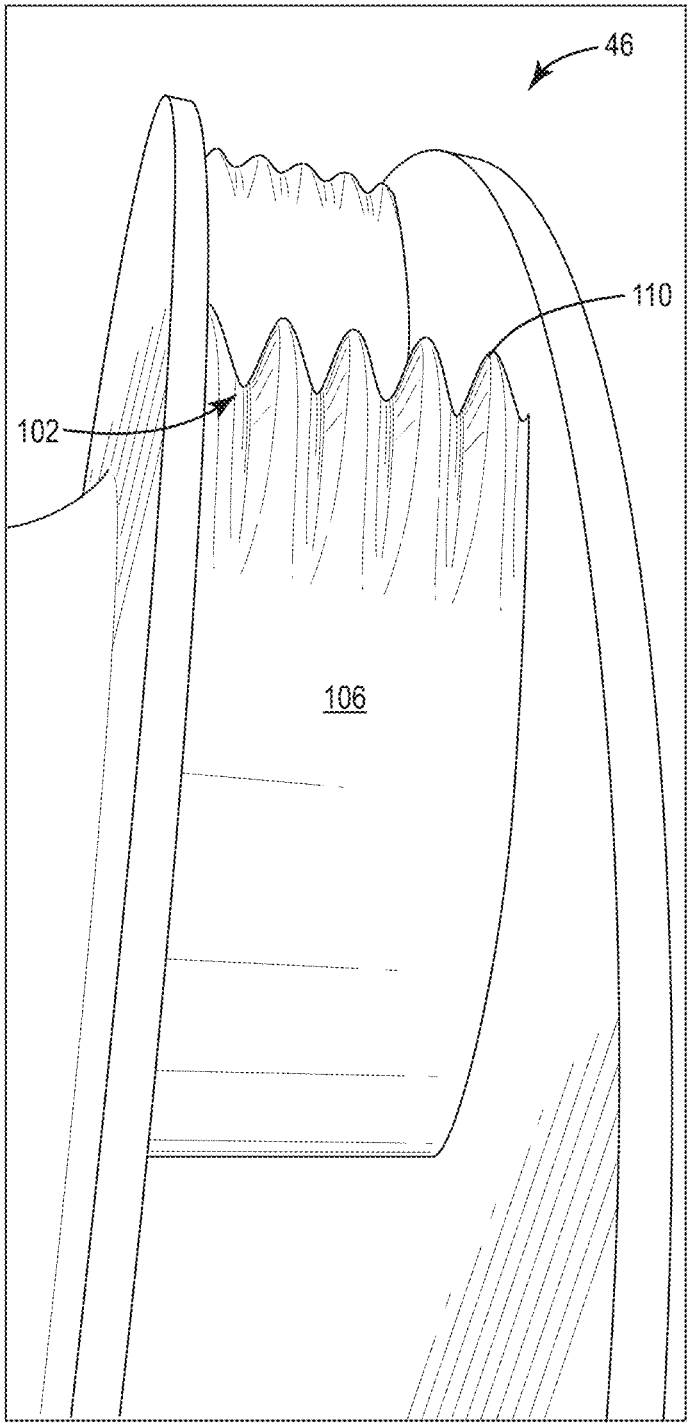
FIG. 9 is an enlarged view of an impeller for use with the ceiling fan.

As shown in FIG. 9, in some embodiments, the impeller 46 may include edge treatments 102 on fins 106 of the impeller 46. The illustrated edge treatment 102 is a sawtooth type pattern, with ridges and valleys formed on an outer edge 110 of each fin 106. The edge treatments 102 help increase the efficiency of and reduce the noise produced by the impeller 46. In other embodiments, the impeller 46 may include other suitable treatments on edges or faces of the fins 106.

In some embodiments, the fan 10 may include accessory modules that releasably or permanently couple to the central hub 14, the annular nozzle 18, and/or the conduits 22. For example, the accessory modules may include additional or alternative light modules coupled to the fan 10. Additionally or alternatively, the accessory modules may include speakers (e.g., a Bluetooth speaker), air fresheners, heating elements, and the like. In some embodiments, the fan 10 may also include a battery backup, such as an integrated lithium-ion battery cell.

In further embodiments, the fan 10 may be controlled remotely by a user. More particularly, the fan 10 may be wirelessly controlled by a remote device, such as a smartphone or tablet computer. In such embodiments, the fan 10 may include a wireless transceiver that communicates with the remote device over a wireless network (e.g., Bluetooth, WiFi, a cellular network, etc.). The fan 10 may also include a processor and memory coupled to the wireless transceiver for receiving information and controlling the fan 10. On the other side, the remote device may include an app or other suitable software to control the fan 10. For example, the app may include controls to turn the fan 10 on/off, change the speed of the fan 10, turn the light module 50 on/off, set a timer for the fan 10 and/or the light module 50, and control any accessory modules attached to the fan 10. The app may also monitor and provide statistics on fan usage.

A desired entrainment ratio for the fan 10 was discovered based on the following information. Through conservation of momentum, the Bernoulli equation can be derived based upon several assumptions of the flow field: steady flow field, incompressible, and negligible frictional effects (inviscid). The Bernoulli equation relates velocity and static and gravitational pressure head for flows in which pressure, gravitational forces, and inertial forces are the primary drivers of the flow field. The Bernoulli equation states that along a streamline:

$$P_1 + \frac{\rho V_1^2}{2} + \rho g z_1 = P_2 + \frac{\rho V_2^2}{2} + \rho g z_2$$

Where A=area, P=static pressure, V=velocity, p=density, g=gravitational constant, and z=position relative to zero gravity datum.

In the case of air as the working fluid, gravity is neglected, leaving:

$$P_1 + \frac{\rho V_1^2}{2} = P_2 + \frac{\rho V_2^2}{2}$$

Considering flow through a channel, the scenario neglects viscous effects. Through control volume analysis and conservation of mass, the mass flow rate into the system and out of the system must be equal. With no change in the fluid density, this can be simplified to say that the volumetric flow rate into and out of the system must be equal. Mathematically this is stated as:

$$V_1 A_1 = V_2 A_2$$

Figure 10A:
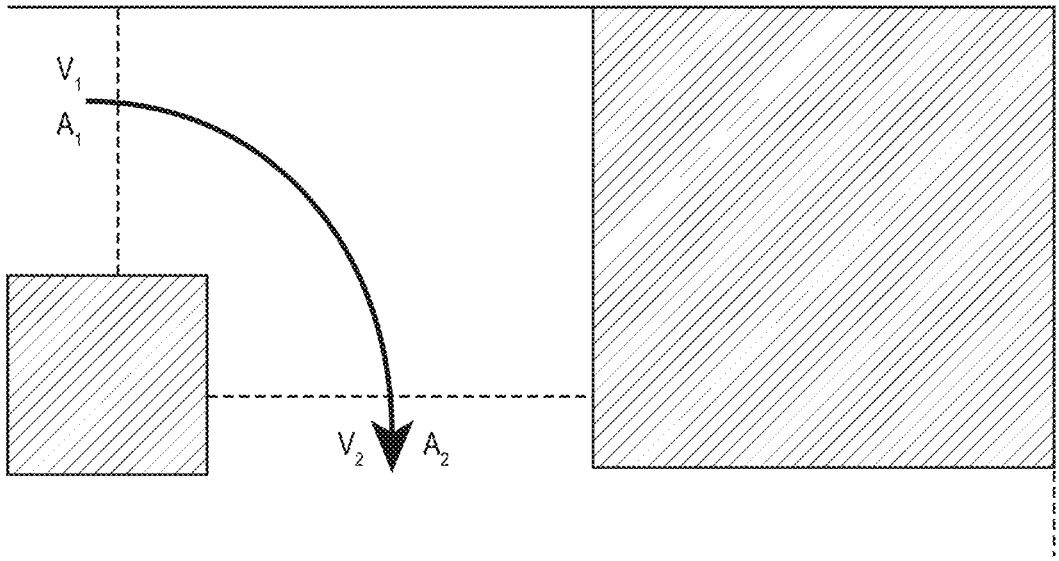
FIG. 10A schematically illustrates an inlet and an outlet of the fan.

Therefore, using the relationship of area and volumetric flow rate with Bernoulli's equation, it is seen as beneficial to not have a reduction in area from point 1 to point 2, as it would require a larger pressure differential to maintain a given flow rate. In fact, a divergent area is desired. Relating this to the fan 10 yields the asymmetric representation shown in FIG. 10A.

As stated previously, it is beneficial, up to the point of over expansion, to have the outlet area, $A_2$, be larger than the inlet area, $A_1$. From this, the area ratio is defined to be:

$$A_R = \frac{A_2}{A_1}$$

Figure 10B:
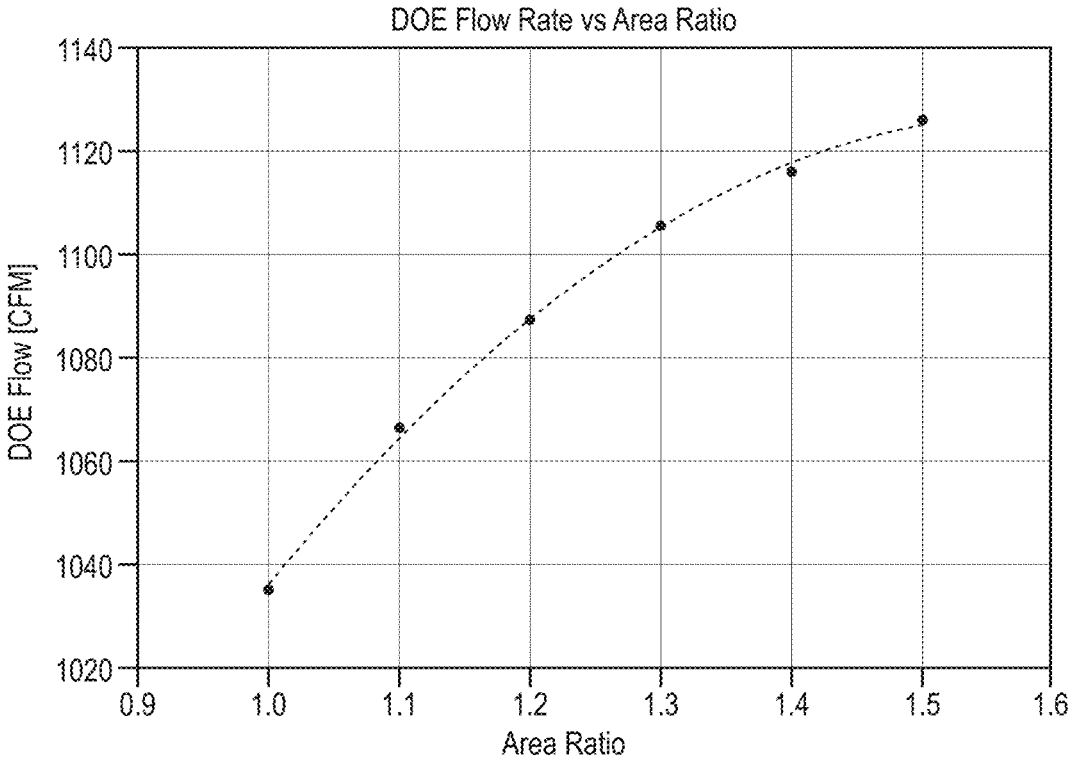
FIG. 10B is a graph of entrained flow rate vs. area ratio of the fan.
Figure 11:
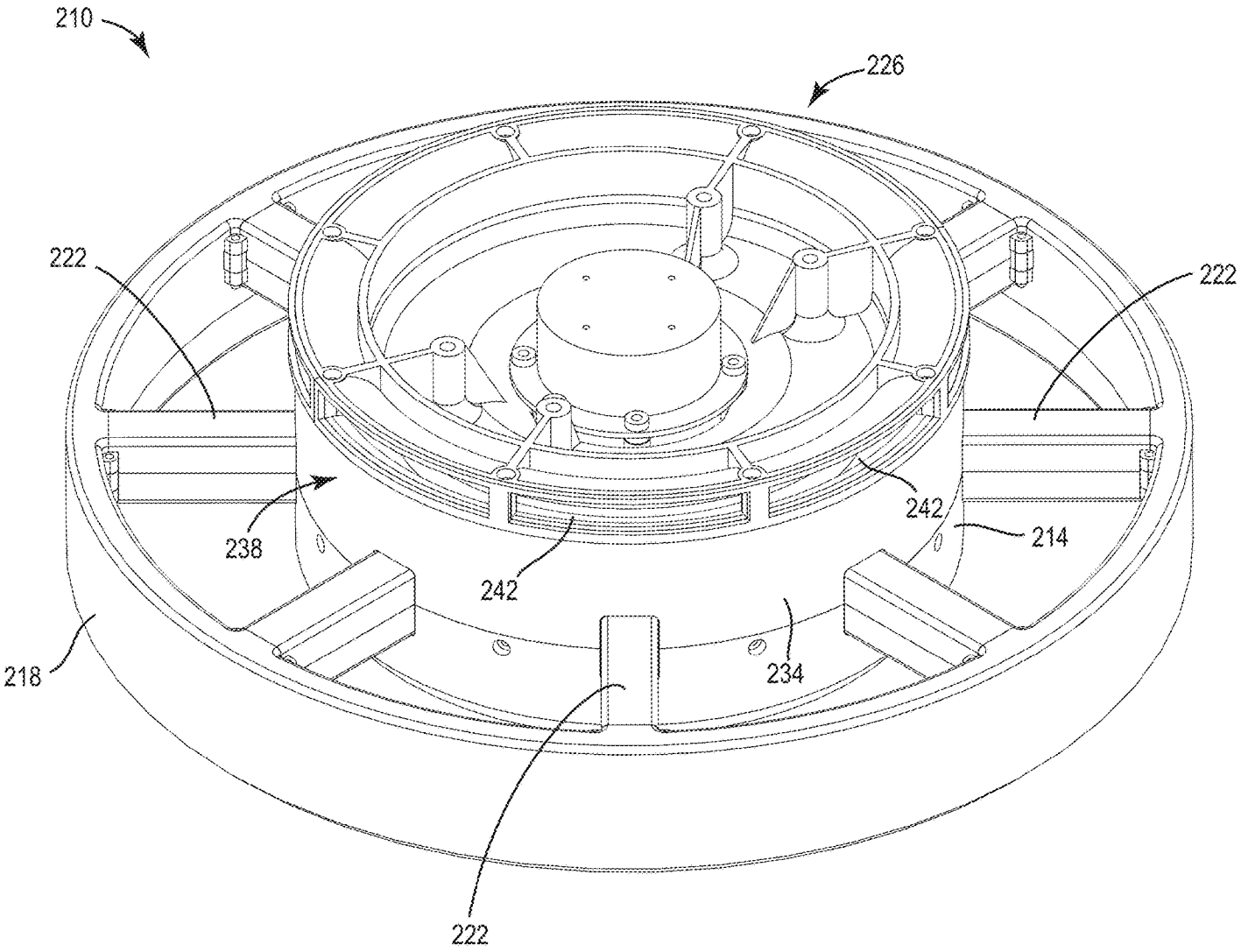
FIG. 11 is a top perspective view of a ceiling fan according to another embodiment.
Figure 12:
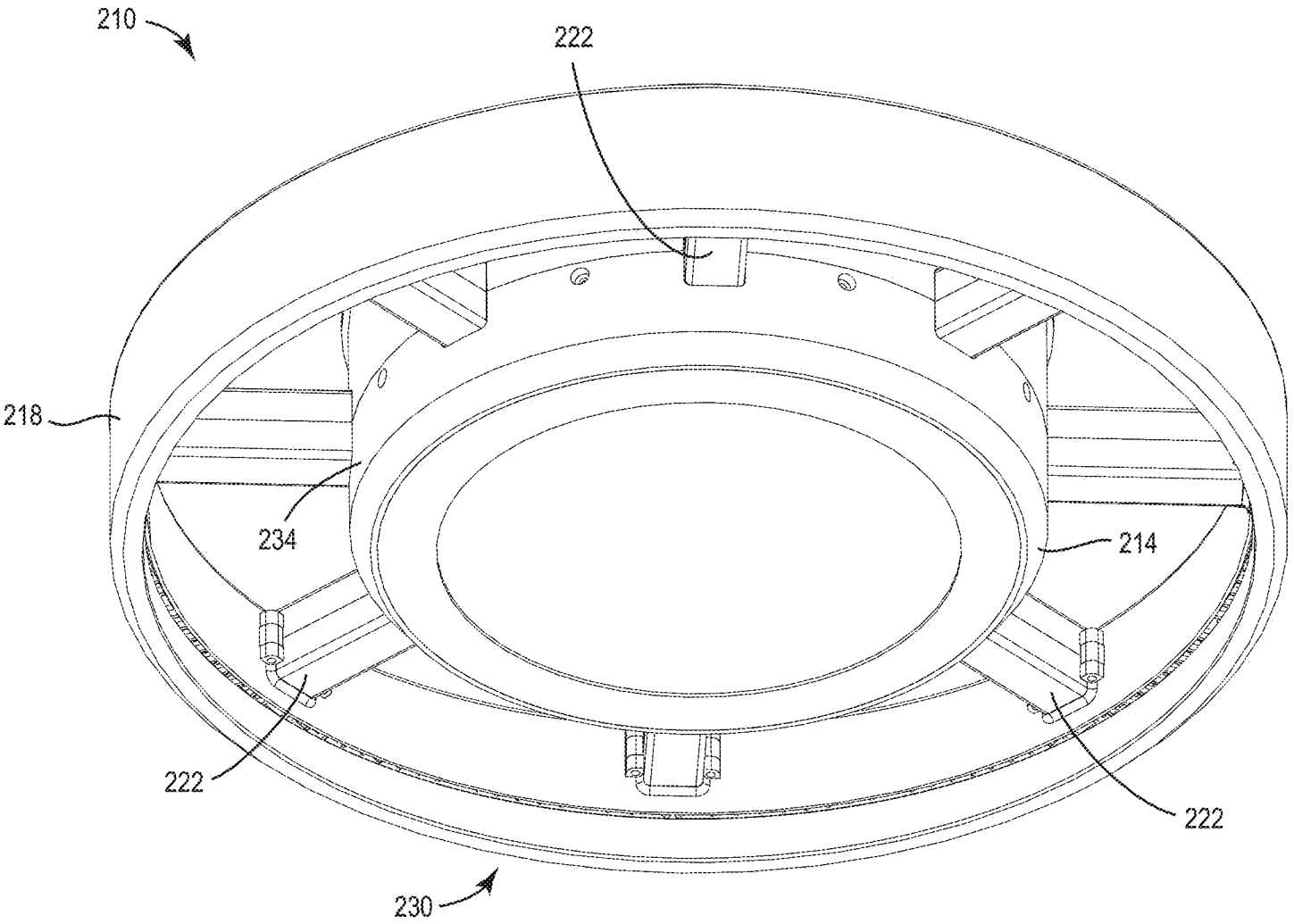
FIG. 12 is a bottom perspective view of the ceiling fan of FIG. 11.

Using the theory stated in the above, a representative data set was generated for the fan 10. The only parameter under consideration is the area ratio, leaving all other variables as constants. FIG. 10B includes a table of the results. As can be seen, increasing the area ratio results in larger entrained flow rates, but with diminishing returns as the ratio approaches over expansion. From this, a desired entrainment ratio for the fan 10 was discovered at 1.25. In some embodiments, the entrainment ratio for the fan 10 can be between 1.0 and 1.5.

FIGS. 11-14 illustrate a fan 210 according to another embodiment of the invention. The fan 210 is similar to the fan 10, and as such, only those features that are different from the fan 10 will be described in detail below.

The illustrated fan 210 includes a central hub 214, an annular nozzle 218 surrounding the central hub 214, and a plurality of conduits 222 connecting the annular nozzle 218 to the central hub 214. In the illustrated embodiment, the fan 210 includes eight conduits connecting the central hub 214 to the annular nozzle 218. The central hub 214 is generally cylindrical and includes a top side 226, a bottom side 230 (FIG. 12) opposite the top side 226, and an outer side 234 spanning between the top and bottom sides 226, 230. The central hub 214 also defines an air inlet 238 for directing air into the fan 210. The air inlet 238 is positioned on the outer side 234 of the central hub 214 adjacent the top side 226. The air inlet 238 includes a plurality of openings 242 that lead into an interior 246 (FIG. 13) of the central hub 214.

Figure 13:
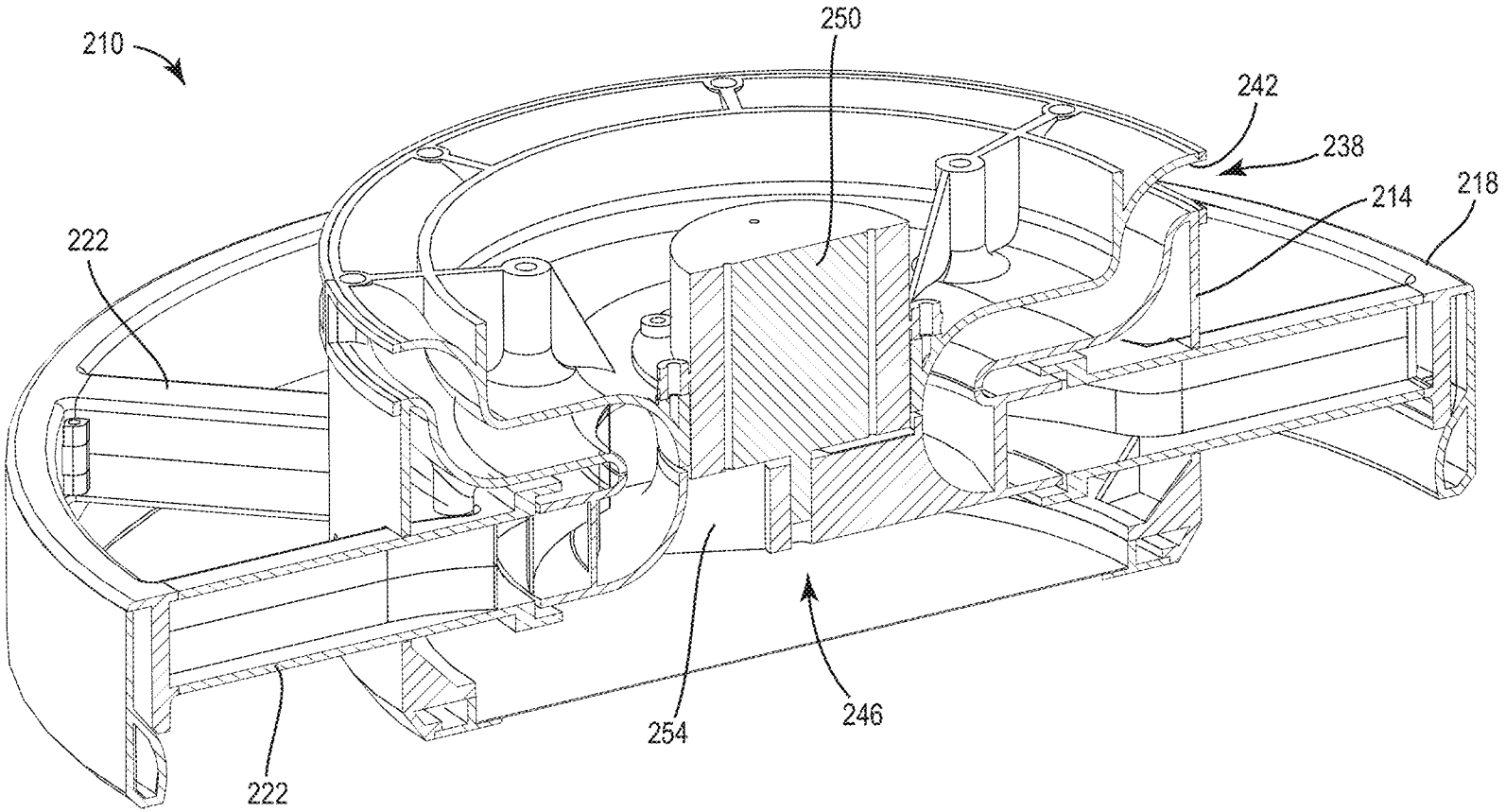
FIG. 13 is a cross-sectional view of the ceiling fan of FIG. 11.

As shown in FIG. 13, the fan 210 includes a motor 250 and an impeller 254 positioned in the interior 246 of the central hub 214. In some embodiments, the motor 250 may be powered by an AC power line in, for example, a wall or ceiling of a building. In other embodiments, the motor 250 may be powered by a battery pack, such as a rechargeable power tool battery pack. When the motor 250 is energized, the motor 250 rotates the impeller 254. As the impeller 254 rotates, the impeller 254 draws air into the fan 210 through the openings 242 in the inlet 238. The impeller 254 propels and directs the air through the conduits 222 to the annular nozzle 218.

Figure 14:
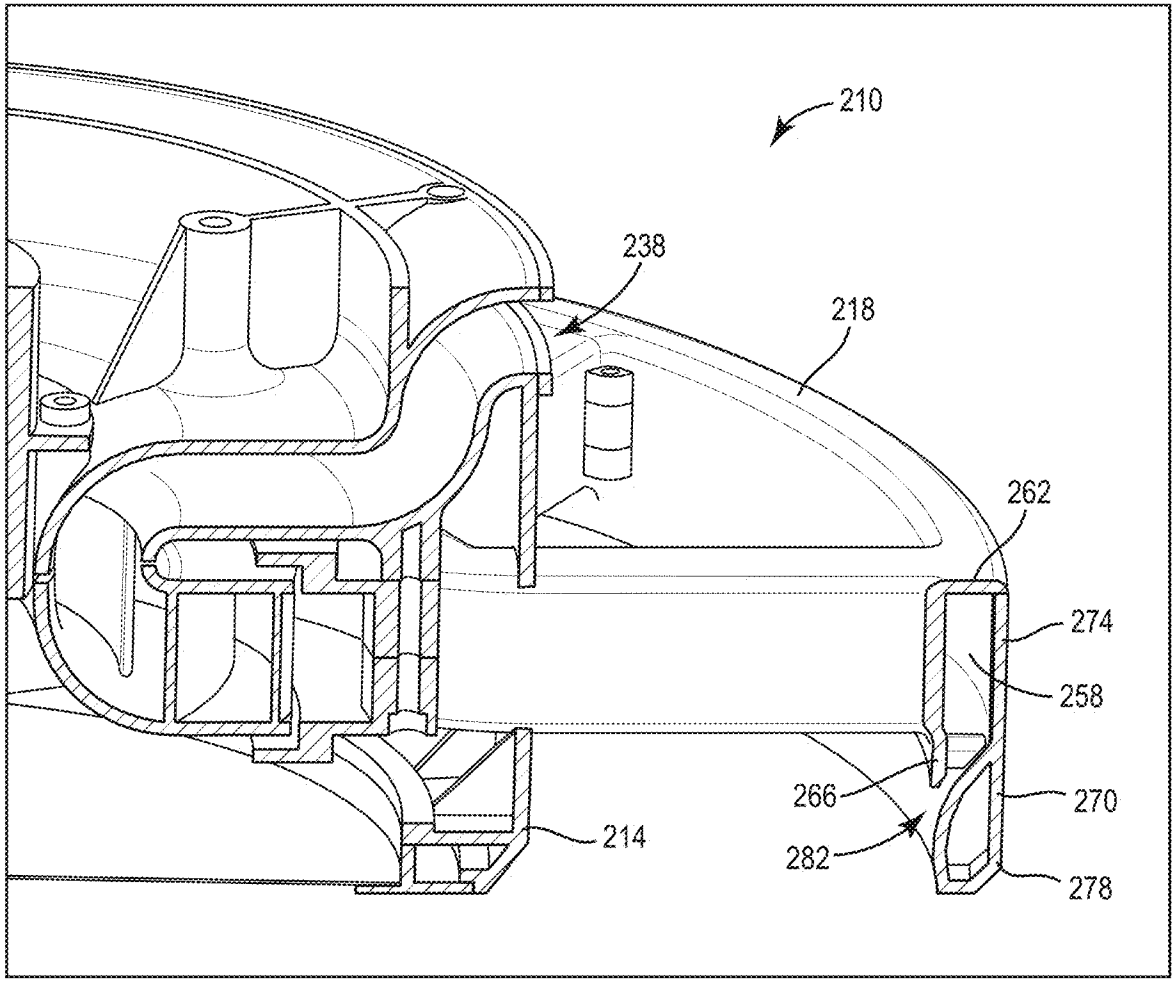
FIG. 14 is an enlarged cross-sectional view of a portion of the ceiling fan of FIG. 11.

The annular nozzle 218 surrounds the central hub 214 and is supported by the conduits 222. As shown in FIG. 14, the annular nozzle 218 defines a channel 258 that receives air from the central hub 214. The channel 258 is defined by a top wall 262, an inner wall 266, and an outer wall 270 of the annular nozzle 218. The outer wall 270 includes a rectilinear upper portion 274 and a tear drop-shaped lower portion 278. The inner wall 266 overlaps a portion of the lower portion 278 of the outer wall 270 to define an outlet 282. The outlet 282 is in communication with the channel 258 to direct the air out of the fan 210. In the illustrated embodiment, the outlet 282 is defined on an inner diameter or the inner wall 266 of the annular nozzle 218. In addition, the outlet 282 is positioned between a top side and a bottom side of the annular nozzle 218.

In operation, air is drawn into the fan 210 through the openings 242 in the inlet 238, passes over and is propelled by the impeller 254, is directed through the conduits 222, flows into the channel 258 of the annular nozzle 218, and is directed out of the fan 210 through the outlet 282.

Figure 15:
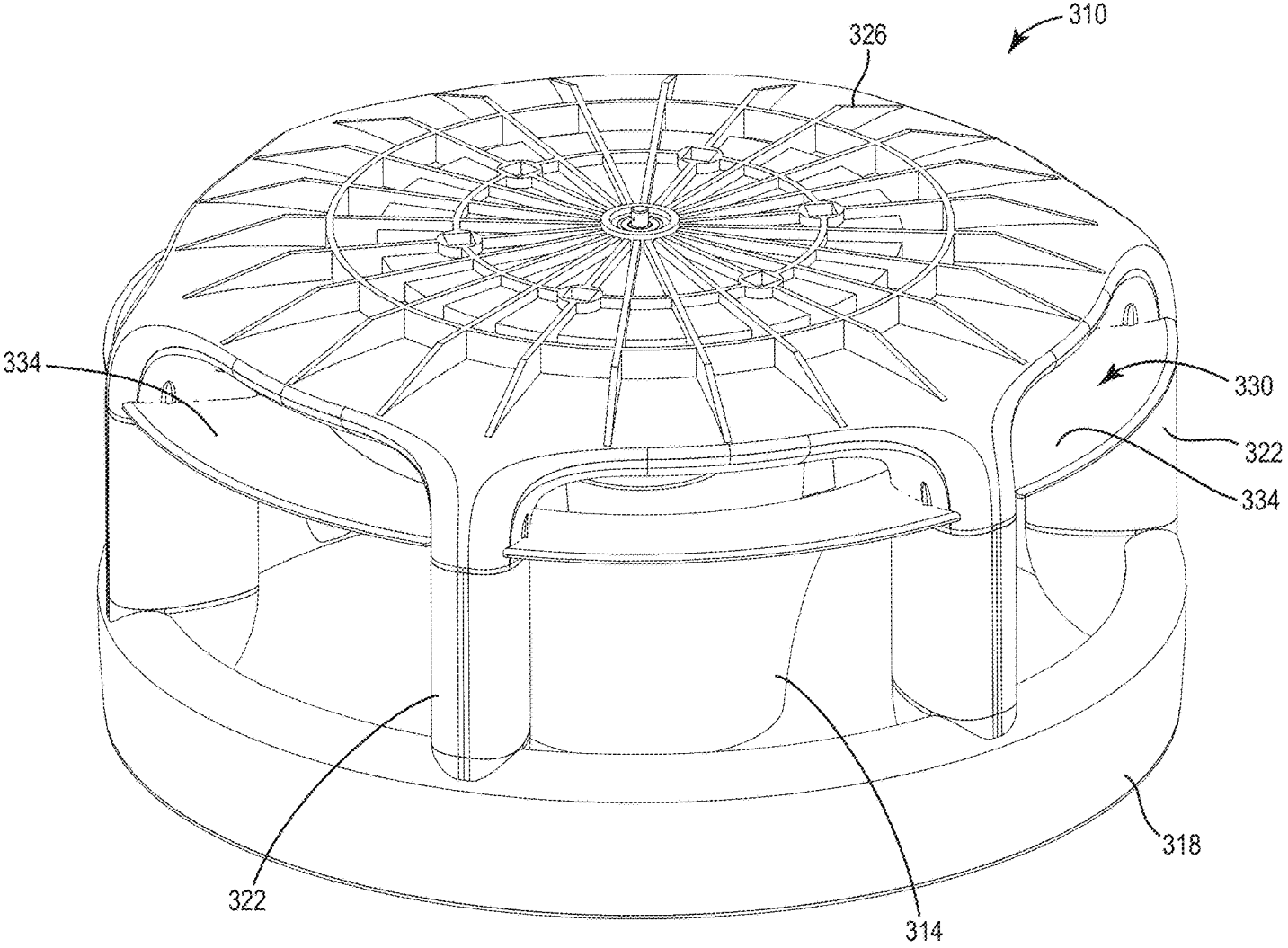
FIG. 15 is a perspective view of a ceiling fan according to another embodiment of the invention.
Figure 16:
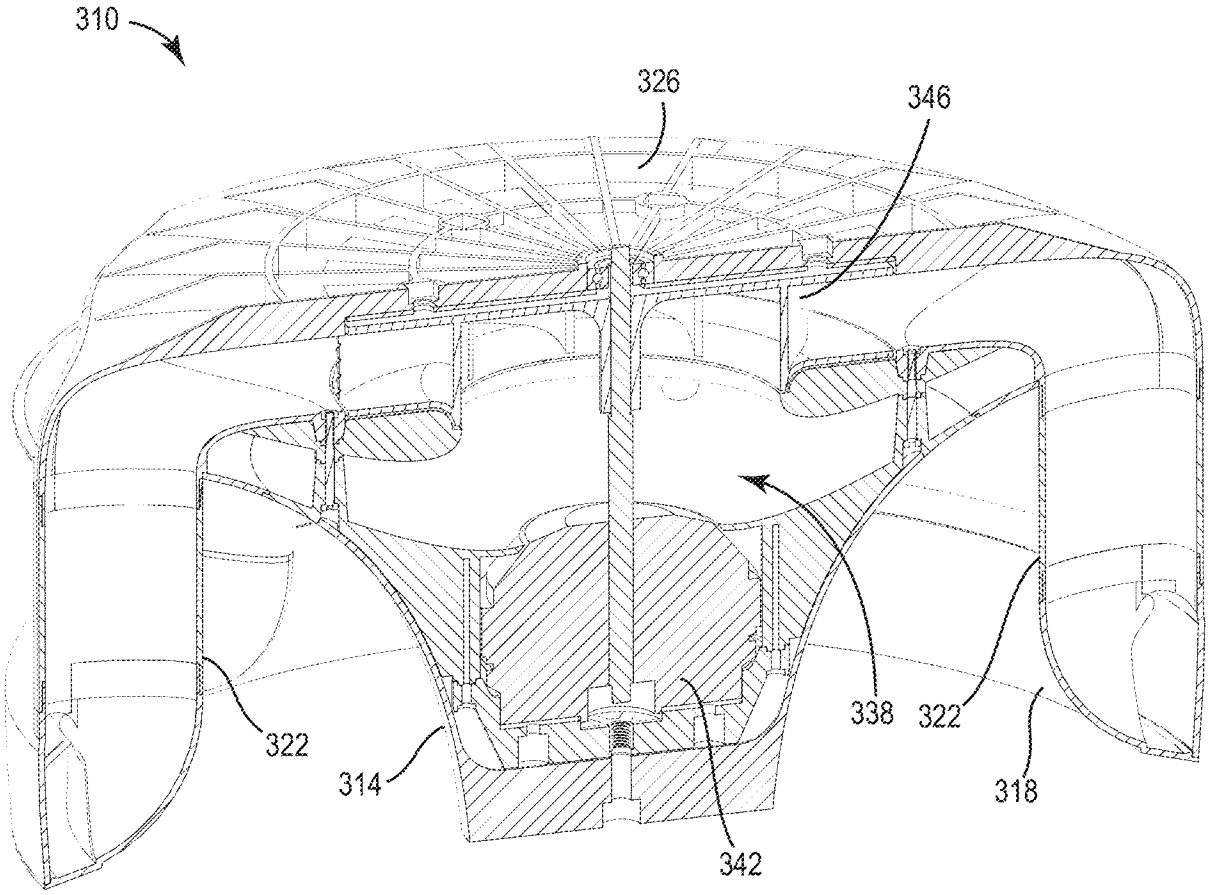
FIG. 16 is a cross-sectional view of the ceiling fan of FIG. 16.
Figure 17:
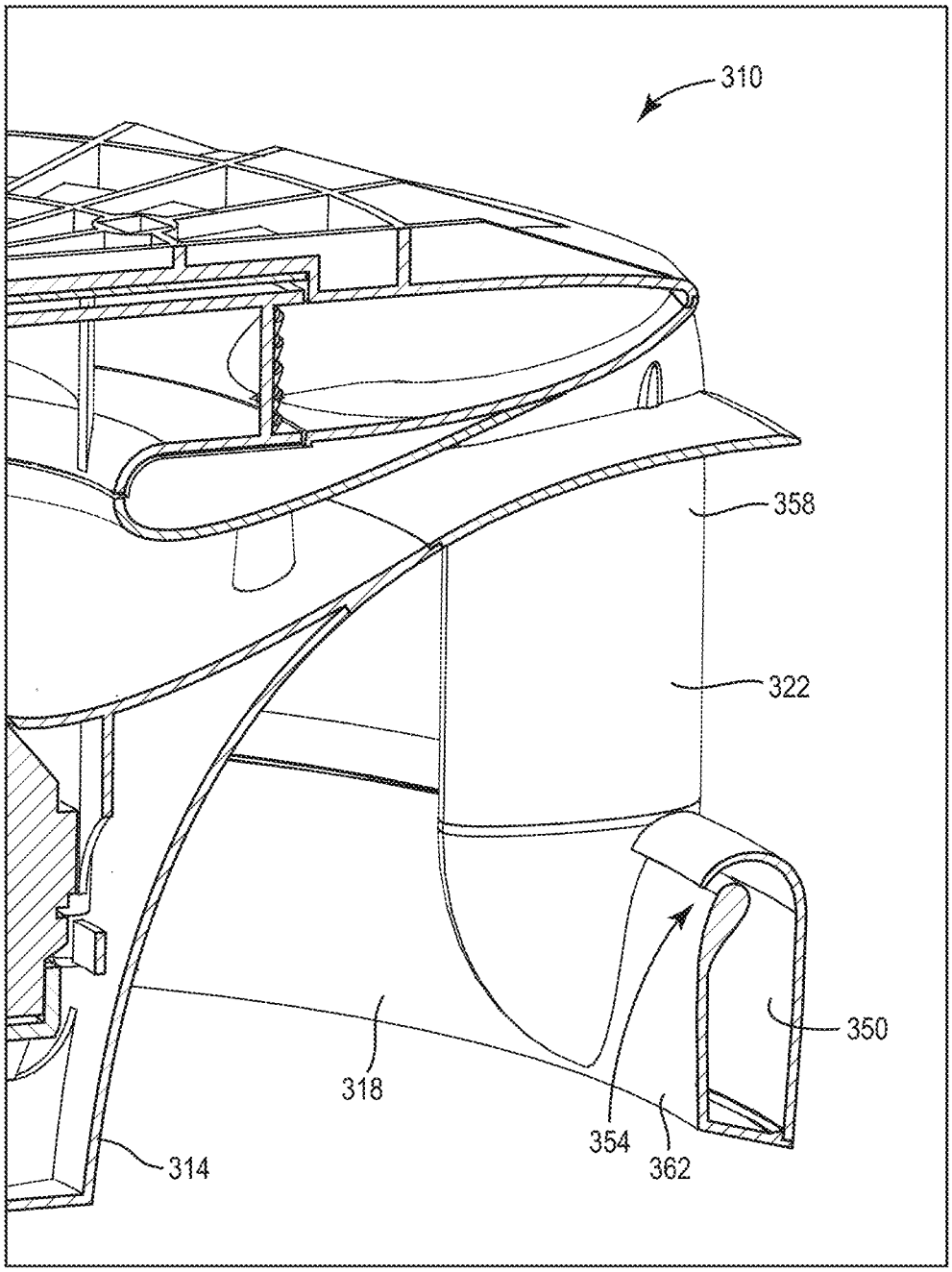
FIG. 17 is an enlarged cross-sectional view of a portion of the ceiling fan of FIG. 16.

FIGS. 15-17 illustrate a fan 310 according to another embodiment of the invention. The fan 310 is similar to the fans 10, 210 and as such, only those features that are different from the fans 10, 210 will be described in detail below.

With reference to FIG. 15, the fan 310 includes a central hub 314, an annular nozzle 318, and a plurality of conduits 322 connecting the annular nozzle 318 to the central hub 314. The central hub 314 is generally cylindrical and is generally positioned above the annular nozzle 318. A top portion 326 of the fan 310 umbrellas over the central hub 314. Together, the top portion 326, annular nozzle 318, and conduits 322 envelop the central hub 314. An inlet 330 is defined between the top portion 326 and the central hub 314 for directing air into the fan 310. The inlet 330 includes a plurality of openings 334 that lead into an interior 338 (FIG. 16) of the central hub 314.

As shown in FIG. 16, the fan 310 includes a motor 342 and an impeller 346 positioned in the interior 338 of the central hub 314. In the illustrated embodiment, the impeller 346 is positioned above and axially aligned with the motor 342. When the motor 342 is energized, the motor 342 rotates the impeller 346. As the impeller 346 rotates, the impeller 346 draws air into the fan 310 through the inlet 330.

The annular nozzle 318 defines a perimeter that the central hub 314 is positioned axially within. In other words, the central hub 314 may be positioned above or below the annular nozzle 318 but still within the perimeter of the annular nozzle 318. As shown in FIG. 17, the annular nozzle 318 defines a channel 350 that receives air from the central hub 314. The annular nozzle 318 also defines an outlet 354 in communication with the channel 350 to direct the air out of the fan 310. In the illustrated embodiment, the outlet 354 is similar to the outlet 62 described above.

In the illustrated embodiment, the conduits 322 extend axially down from the central hub 314 to support the annular nozzle 318. In the illustrated embodiment, the fan 310 includes six conduits 322. Each conduit 322 has a first end 358 coupled to the central hub 314 and a second end 362 coupled to the annular nozzle 318. The conduits 322 define flowpaths from the central hub 314 (and, more particularly, the impeller 346) to the annular nozzle 318. In operation, air is drawn into the fan 310 through the inlet 330, passes over and is propelled by the impeller 346, is directed through the conduits 322, flows into the channel 350 of the annular nozzle 318, and is directed out of the fan 310 through the outlet 354.

Although the invention has been described above with reference to certain preferred embodiments, variations exist within the spirit and scope of the present invention. Various features and advantages of the invention are set forth in the following claims.

What is claimed is:

1. A fan comprising:

a central hub defining an inlet;

a motor positioned within the central hub;

an impeller positioned within the central hub, the impeller operable to be rotated by the motor to generate air movement;

a nozzle defining a channel that receives air from the central hub, the nozzle defining an outlet in communication with the channel to direct air out of the nozzle; and a plurality of conduits connecting the nozzle to the central hub to direct air from the central hub to the channel and through the outlet of the nozzle;

wherein the nozzle defines a projection aligned with each conduit to divide air movement through the nozzle.

2. The fan of claim 1, wherein each projection is formed on an inner surface of the nozzle and extends toward the corresponding conduit.

3. The fan of claim 1, wherein the nozzle includes a plurality of baffles positioned between the plurality of conduits to separate the nozzle into discrete sections.

4. The fan of claim 1, wherein the impeller is axially aligned with the motor.

5. The fan of claim 1, wherein the central hub is positioned within a perimeter defined by nozzle.

6. The fan of claim 5, wherein the nozzle is an annular nozzle, and wherein the annular nozzle surrounds the central hub.

7. The fan of claim 1, wherein the outlet is defined on an inner diameter of the nozzle.

8. The fan of claim 1, wherein the outlet is defined by a gap between a first wall and a second wall of the nozzle.

9. The fan of claim 8, wherein the first wall overlaps the second wall to define the gap.

10. The fan of claim 1, wherein the plurality of conduits extend radially from the central hub to support the nozzle.

11. The fan of claim 1, wherein the impeller includes fins with an outer edge having a saw tooth type pattern with ridges and valleys.

12. The fan of claim 1, further comprising a filter covering the inlet.

13. The fan of claim 12, wherein the filter is a ring-shaped member divided into a plurality of pieces that are separately removable from the central hub.

14. The fan of claim 1, wherein an entrainment ratio, defined as an area of the outlet over an area of the inlet, is between 1.0 and 1.5.

15. The fan of claim 14, wherein the entrainment ratio is 1.25.

16. A fan comprising:

a central hub defining an inlet;

a motor positioned within the central hub;

an impeller positioned within the central hub, the impeller operable to be rotated by the motor to generate air movement, the impeller including fins, each fin having an edge treatment of ridges and valleys formed on an outer edge of the fin;

a nozzle defining a channel that receives air from the central hub, the nozzle defining an outlet in communication with the channel to direct air out of the nozzle; and a plurality of conduits connecting the nozzle to the central hub to direct air from the central hub to the channel and through the outlet of the nozzle.

17. The fan of claim 16, wherein the nozzle includes a plurality of baffles positioned between the plurality of conduits to separate the nozzle into discrete sections.

18. A fan comprising: a central hub defining an inlet; a motor positioned within the central hub; an impeller positioned within the central hub, the impeller operable to be rotated by the motor to generate air movement; a filter covering the inlet, the filter divided into a plurality of pieces that are separately removable from the central hub; a nozzle defining a channel that receives air from the central hub, the nozzle defining an outlet in communication with the channel to direct air out of the nozzle; and a plurality of conduits connecting the nozzle to the central hub to direct air from the central hub to the channel and through the outlet of the nozzle.

19. The fan of claim 18, wherein the filter is a ring-shaped member.

20. The fan of claim 18, wherein the plurality of pieces includes a first piece and a second piece that are mirror-symmetric.

* * * * *